United States Patent [19]

Patrinos

[11] 4,214,678

[45] Jul. 29, 1980

[54] CONDIMENT DISPENSER WITH HOLE-CLEARING MEANS

[76] Inventor: Peter Patrinos, 1525 Fourth Ave., Altoona, Pa. 16602

[21] Appl. No.: 965,530

[22] Filed: Dec. 1, 1978

[51] Int. Cl.[2] ..... B67D 1/08

[52] U.S. Cl. ..... 222/149

[58] Field of Search ..... 222/148, 149, 151, 480, 222/518, 322, 501, 196.1–196.5; 239/114–117, 583; 137/244, 245.5

[56] References Cited

U.S. PATENT DOCUMENTS

| | | | |
|---|---|---|---|
| 810,107 | 1/1906 | Cohencius | 222/149 |
| 820,835 | 5/1906 | Ullmann | 239/583 |
| 843,356 | 2/1907 | Parker . | |
| 890,304 | 6/1908 | Rosenberg . | |
| 964,433 | 7/1909 | Kinsley | 222/150 |
| 1,238,118 | 8/1917 | Edmunds | 222/149 |
| 2,083,624 | 6/1937 | Watson | 222/149 |
| 2,251,192 | 7/1941 | Krumsiek et al. | 239/117 |
| 2,479,811 | 8/1949 | Calise . | |
| 2,480,421 | 8/1949 | Ranson . | |
| 2,656,076 | 10/1953 | Von Essen | 222/196.3 |
| 2,681,749 | 6/1954 | Von Essen | 222/196.3 |
| 3,197,077 | 7/1965 | Amster | 222/149 |

FOREIGN PATENT DOCUMENTS

| | | | |
|---|---|---|---|
| 1016037 | 10/1952 | France | 222/518 |

*Primary Examiner*—H. Grant Skaggs
*Attorney, Agent, or Firm*—Finnegan, Henderson, Farabow, Garrett & Dunner

[57] ABSTRACT

A condiment dispenser including a container having a plurality of dispensing openings in the top surface thereof; a plurality of prongs disposed within the container including an individual prong corresponding to, and aligned for insertion into each of the openings; a camming bar rotatably mounted in the container for forcing the prongs into the dispensing openings upon rotation of the camming bar, and a spring for biasing the prongs away from the dispensing openings and against the camming bar. The dispensing openings, prongs, camming bar and spring may all be located in a removable cap portion of the container. The camming bar may include a bar extending completely across the cap having an elongated U-shaped projection fixed thereon and an external knob attached to the bar.

7 Claims, 6 Drawing Figures

CONDIMENT DISPENSER WITH HOLE-CLEARING MEANS

FIELD OF THE INVENTION

This invention relates to a condiment dispenser having self-contained means for clearing or unclogging the dispensing openings of the dispenser.

BACKGROUND OF THE INVENTION

Over the years, one of the most persistent problems encountered in the dispensing of condiments, such as salt, has been the tendency of such condiments to agglomerate and become stuck in the dispensing openings of the shaker or other controlled type dispenser. This problem is particularly troublesome in geographical areas which are exposed to very high humidity, since the water vapor in the air often condenses on the condiment particles in such a dispenser causing further agglomeration.

Numerous solutions to this problem have been proposed, many of which utilize a series of prongs or fingers to be extended into the openings of a dispenser to clear the openings of any clogged condiment. In several devices, such as those disclosed in U.S. Pat. Nos. 2,479,811; 2,681,749; and 2,656,076, these prongs are permanently fixed in the dispensing openings of the condiment container, and movement of the prongs is controlled by the action of inverting the container. In such devices, however, condiment particles may be become lodged in the openings surrounding the prongs themselves, thus preventing the prongs from moving when the dispenser is inverted. A similar problem may occur in any device which has a rod or prong extending through the dispensing end of the container, such as those disclosed in U.S. Pat. Nos. 3,197,077 and 2,083,624. Several other approaches to this clogging problem have included the use of some type of biasing means to control the movement of the prongs into and out of the dispensing openings. U.S. Pat. Nos. 964,433; 2,480,421; and 1,238,118 all disclosed structures in which some portion of the bottom surface of the condiment dispenser can be forced upward against a spring bias to project a set of prongs into the dispensing openings. Dispensers such as those disclosed in these patents are somewhat complicated to produce, and their clearing mechanisms are not readily adapted to use with normally available condiment containers of standard designs. Also, such clearing structures may not be wholly contained within a cap portion of such a dispenser.

Accordingly, it is a primary object of this invention to improve condiment dispensers having a manually operated hole clearing means.

It is a further object of this invention to provide an improved condiment dispenser in which the hole-clearing means is not, itself, subject to clogging.

Another object of the invention is to provide an improved condiment dispenser with the hole-clearing mechanism wholly contained within a cap portion of the dispenser.

Additional objects and advantages of the invention will be set forth in part in the description which follows, and in part will be obvious from the description, or may be learned by practice of the invention. The objects and advantages of the invention may be realized and obtained by means of the instrumentalities and combinations particularly pointed out in the appended claims.

SUMMARY OF THE INVENTION

To achieve the foregoing objects and in accordance with the purpose of the invention, as embodied and broadly described herein, the condiment dispenser of this invention comprises a container for holding the condiment to be dispensed, having a dispensing opening in the top surface thereof; prong means disposed within said container including an individual prong corresponding to, and aligned for insertion into, the opening; camming bar means rotatably mounted in the container for forcing the prong into the dispensing opening to clear the dispensing opening upon rotation of the camming bar means; and means for biasing the prong means away from the dispensing opening and against the camming bar means.

Preferably the container includes a plurality of openings and the prong means includes prongs individual to each of the plurality of openings. It is also preferred that the container include a removable cap portion, the dispensing openings being located therein, and the prong means, bar means and biasing means being mounted in the cap portion.

The bar means preferably includes a bar extending completely across the cap, having an elongated U-shaped projection fixed thereon. An external knob maybe attached to the bar for facilitating manual rotation.

It is also preferred that the prong means include a frame with the individual prongs fixed to the frame. The openings may form a circle in which case the frame is ring-shaped.

Preferably, the biasing means includes a coiled spring disposed between the frame and the top surface of the cap.

The spring may be frustro-conical in shape with its largest cross-section adjacent the top surface of the cap.

BRIEF DESCRIPTION OF THE DRAWINGS

The accompanying drawings which are incorporated in and constitute a part of this specification, illustrate one embodiment of the invention and, together with the description, serve to explain the principles of the invention.

Figure 1:
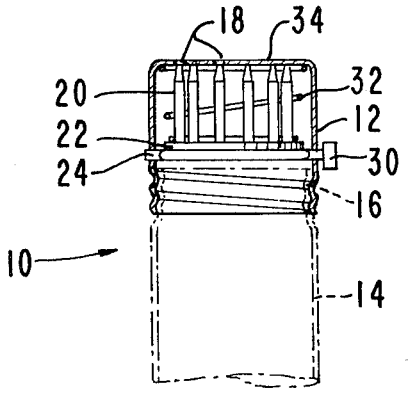
Figure 2:
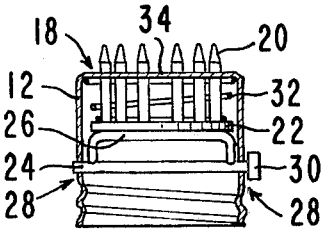
Figure 3:
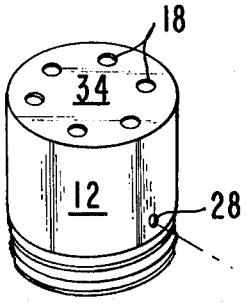
Figure 4:
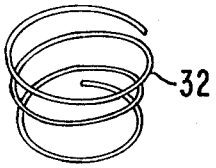
Figure 5:
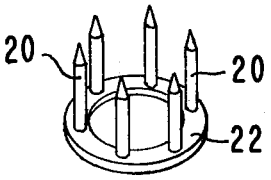

OF THE DRAWINGS:

FIG. 1 is a side view of an assembled container constructed in accordance with the teachings of this invention;

FIG. 2 is a similar view of the cap portion of the container with the prong means extending through the dispensing openings;

FIG. 3 is a perspective view of the cap portion;

FIG. 4 is a perspective view of the coiled spring;

FIG. 5 is a perspective view of the prongs mounted on a circular frame; and

Figure 6:
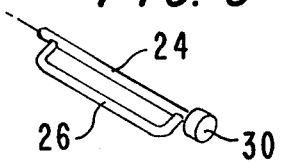

FIG. 6 is a perspective view of the camming bar means.

DESCRIPTION OF THE PREFERRED EMBODIMENT

Reference will now be made in detail to the present preferred embodiment of the invention, an example of which is illustrated in the accompanying drawings.

Referring now to FIGS. 1 and 2 it may be seen that the dispenser comprises a container, generally 10, for holding the condiment to be dispensed. The container 10 has a dispensing opening in the top surface thereof. In the illustrated embodiment, the container 10 has a cap portion 12 which may be attached to the container by any suitable means. The body portion 14 of the container in the illustrated embodiment, includes a series of threads 16 on the top surface thereof onto which the cap portion 12 may be screwed. As shown in FIG. 3, a plurality of dispensing openings 18 are included in the top surface of the cap portion 12.

Prong means are disposed within the container 10 including an individual prong corresponding to, and aligned for insertion into, the opening. As here embodied, the prong means includes a plurality of individual prongs 20 corresponding to and aligned for insertion into a plurality of openings 18. The prongs 20 may be mounted on a frame 22 and may be formed of any suitable material. Each individual prong 20 is pointed at the upper end thereof for easy insertion into the dispensing openings 18. Preferably, the openings 18 form a circle and the frame 22 is ring-shaped.

In accordance with the invention, camming bar means are rotatably mounted in the container for forcing the prong into the dispensing opening to clear the dispensing opening upon rotation of the camming bar means. As here embodied, the camming bar means includes a bar 24 extending completely across the cap 12. The bar 24 has an elongated U-shaped projection 26 fixed thereon. A pair of holes 28 are provided in the cap portion 12 to receive the bar 24. Preferably, an external knob 30 is attached to one end of the bar 24 for facilitating manual rotation of the bar. The hole 28 corresponding to the end of the bar 24 opposite external knob 30 may extend only part way through the cap 12.

In accordance with the invention, means are provided for biasing the prong means away from the dispensing openings and against the camming bar means. As embodied herein, the biasing means includes a coiled spring 32 disposed between the frame 22 and the top surface of the cap 34 generally surrounding the prongs 20. Preferably the spring 32 is shaped as a frustrum of a cone having its largest cross-section adjacent the top surface of the cap 34.

Preferably, as shown in FIG. 2, the prong means, bar means, and biasing means are all mounted in the cap portion 12. However, all of these elements may also be permanently fixed within a container, itself.

As best shown in FIG. 2, the operation of the invention to clear the dispensing openings of the condiment dispenser requires only a simple manual rotation of the external knob 30 on the camming bar 24. As the bar 24 rotates, U-shaped projection 26 comes in contact with circular frame 22, forcing the prongs 20 upward into the dispensing openings against the bias of spring 32. Continued rotation of the bar 24 causes the U-shaped projection 26 to move downward and allows the spring 32 to force the prongs 20 and frame 22 downward onto camming bar 24. In this position, it is preferred that the points of the prongs 20 extend slightly into the dispensing openings 18. In addition, the cap portion 12 should have a thickness of at least approximately 1/16 to ⅛ inch. This allows the cap portion 12 to serve as a guide for the prongs 22.

The knob 30 may be rotated in either direction to actuate the prongs 22. The frusto-conical shape of the spring allows for a tight fit within the cap.

The cap 12 and the other components of the invention such as the camming bar means and the prong means may be formed of metal, plastic, or any suitable material. The cap 12 may also be dimensioned for threadable attachment to various standard sized condiment containers.

Thus the invention provides a practical, durable and useful device which may be economically manufactured, and which includes substantial improvements over prior devices of this type.

It will be apparent to those skilled in the art that various modifications and variations could be made in the condiment dispensers of the invention without departing from the scope or spirit of the invention.

What is claimed is:

1. A condiment dispenser comprising:

a container for holding the condiment to be dispensed, said container having a plurality of dispensing openings in the top surface thereof, and a removable cap portion, said dispensing openings being located in said cap portion;

prong means mounted in said cap portion including an individual prong corresponding to, and aligned for insertion into, each of said openings;

camming bar means rotatably mounted in said cap portion for forcing said prongs into said dispensing openings to clear the dispensing openings upon rotation of said camming bar means; and means mounted in said cap portion for biasing said prong means away from said dispensing openings and against said camming bar means.

2. The dispenser of claim 1 wherein said bar means includes a bar extending completely across said cap, said bar having an elongated U-shaped projection fixed thereon.

3. The dispenser of claim 2 wherein said bar means also includes an external knob attached to said bar for facilitating manual rotation of said bar.

4. The dispenser of claim 3 wherein said prong means includes a frame, said individual prongs being fixed to said frame.

5. The dispenser of claim 4 wherein said openings form a circle and said frame is ring-shaped.

6. The dispenser of claim 5 wherein said biasing means includes a coiled spring disposed between said frame and the top surface of said cap.

7. The dispenser of claim 8 wherein said spring is frusto-conical in shape having its largest cross-section adjacent the top surface of said cap.

* * * * *